United States Patent [19]

Fapiano

[11] Patent Number: 4,718,262

[45] Date of Patent: Jan. 12, 1988

[54] METHOD FOR CONTROLLING EDGE TAPER IN METAL ROLLING MILL

[75] Inventor: Donald J. Fapiano, Salem, Va.

[73] Assignee: General Electric Company, Salem, Va.

[21] Appl. No.: 371,366

[22] Filed: Apr. 23, 1982

[51] Int. Cl.[4] ..... B21B 37/12

[52] U.S. Cl. ..... 72/6; 72/243

[58] Field of Search ..... 72/6, 243

[56] References Cited

U.S. PATENT DOCUMENTS

| | | | |
|---|---|---|---|
| 3,312,092 | 4/1967 | Neumann | 72/13 |
| 3,630,055 | 12/1971 | Fapiano et al. | 72/6 |
| 3,938,360 | 2/1976 | Shida et al. | 72/8 |
| 4,137,741 | 2/1979 | Fapiano et al. | 72/6 |

OTHER PUBLICATIONS

"Mathematical Modeling System for Cold Tandem Mills: Influence of Rolling and Roll Bending Forces on Strip Crown" by J. V. Poplawski et al. *Proceeding of the 23rd Mechanical Working and Steel Processing Conference* on Oct. 28 and 29, 1981–published 1982. pp. ii, v, 218–250.

"Effect of Hot- and Cold- Rolling Operation on Strip Crown and Feather Edge" by *R. R. Somers, Proc. International Conference on Steel Rolling, The Iron and Steel Institute of Japan,* pp. 701–712, Sep. 29–Oct. 4, 1980.

"Reduction in the Thickness Deviation of Hot Strip" by A. Adachi et al., date and publication status unknown.

"New Approach to the Computer Setup of the Hot Strip Mill" by S. Wilmotte et al., *Iron and Steel Engineer Yearbook,* 1977.

"Theory and Practical Aspects in Crown Control" by M. D. Stone et al., *Iron and Steel Engineer Yearbook,* 1965.

"Shape Control of Steel Strip with Sumitomo Variable Crown Roll System" by T. Kurashige et al., *Proc. International Conference on Steel Rolling, The Iron and Steel Institute of Japan,* pp. 521–531, Sep. 29–Oct. 4, 1980.

*Primary Examiner*—Lowell A. Larson

*Attorney, Agent, or Firm*—Arnold E. Renner

[57] ABSTRACT

A method for controlling edge taper ("feather") in a rolled metal strip utilizes a rolling mill having at least one pair of opposed work rolls through which the strip is passed for thickness reduction. The method first provides that a target rolling pressure is established as a function of the desired maximum amount of edge taper. A target crown for the finished strip is then established and the final work roll crown which will produce the target crown at the target rolling pressure is determined. The work roll crown is then adjusted to the final work roll crown for making the final pass of the strip through the work rolls.

6 Claims, 8 Drawing Figures

METHOD FOR CONTROLLING EDGE TAPER IN METAL ROLLING MILL

BACKGROUND OF THE INVENTION

The present invention relates generally to metal rolling mills and more particularly to a scheme for controlling workpiece edge taper or "feather" in rolled metal workpieces, hereinafter also referred to as strip. In this specification the term "edge taper" and "feather" are interchangeably used.

In the discipline of metal rolling, it has been long been known that control of the transverse thickness profile on the final rolling pass is necessary to limit overweight, and that control of thickness profile on successive passes is essential in producing strip of acceptable flatness. The difference in strip thickness at edge and center is referred to as strip crown, and the crown and flatness characteristics combined are often referred to as the strip "shape".

In the prior art, crown has been defined in terms of strip thickness profile over a region excluding the outermost 40–50 mm at each edge. For example, Wilmotte et al., in "A New Approach to the Computer Setup of a Hot Strip Mill", *Iron and Steel Engineer,* September, 1977 (p. 70) exclude the outermost 40 mm at each edge before defining strip profile indices. There are two primary reasons for this exclusion of the tapered edge regions in prior art considerations. First, most producers outside of the United States of America continue to sell hot rolled strip by actual weight rather than by Theoretical Minimum Weight (TWM) as is the practice in the United States. This reduces the importance of the strip overweight problem and, thus, factors which influence overweight. Secondly, the analysis of the deformation of rolls and strip in the edge regions is complicated by many factors. For example, the strip entering the final pass already exhibits edge taper as well as unknown temperature profile in the extreme edge region. The roll, which is generally composed of shell and core sections of different materials, recovers from its deformed to its undeformed state at strip edge in a manner not previously examined in the rolling technology. And, finally, the flow characteristics of the strip as it changes from a constrained environment over most of its width to an unconstrained environment at its extreme edges defy exact analysis. The result of these circumstances has been the neglect of the strip edge behavior even though, as will be shown, it is a significant factor in strip overweight.

Prior art shape control has addressed the control of strip crown and flatness through load distribution; i.e., the force and draft on successive passes through the mill stand or succession of mill stands. A key factor influencing strip crown is the unloaded roll crown. In simpler systems, roll crown is governed by the roll grinding practice, the thermal expansion and wear of the rolls in the mill stand. In more complex systems such as those having roll bending systems, of which more will be said later, the effect of the roll bending system is also considered in estimating the unloaded roll crown. The strip crown produced in passing through the mill rolls is determined by the unloaded roll crown and the deflection of the mill rolls by the rolling force. Thus, a given roll crown and a given delivered strip crown will determine a corresponding rolling force. The draft required to produce that force can be determined from the deformation resistance of the strip.

Examples of workpiece shape control which consider force and draft as well as roll crown to control the strip crown and shape are found in the previously cited Wilmotte article and in U.S. Pat. No. 3,630,055 "Workpiece Shape Control" by Donald J. Fapiano et al., issued Dec. 28, 1971 and its improvement U.S. Pat. No. 4,137,741 "Workpiece Shape Control" issued to Donald J. Fapiano et al., on Dec. 22, 1977. Neither of these patents includes roll bending as a means of controlling roll crown and both assume a specified strip crown. The aspects of roll bending to control crown have, however, been known for a long period of time and an example of such a system and its effects is found in the article "Theory and Practical Aspects in Crown Control" by Dr. M. D. Stone and R. Gray which article was published in *Iron and Steel Engineering Yearbook,* 1965. This article, as well as the foregoing patents and article are specifically incorporated hereinto by reference for their teachings.

While various aspects of crown control and the shape control have been known for years, what has not been previously understood is that the above procedures also determine, to a large extent, the resulting strip edge taper or feather. These terms refer to the abrupt reduction in strip thickness which occurs in the region of from one to two inches from the edge of the strip. This change in thickness can be as much as 0.01 inch or more and often exceeds 0.005 inch. Although the strip normally has its sides trimmed, this trimming usually amounts to only $\sqrt[3]{}$ to ½ of an inch, in steel applications, and thus considerable feather can remain, even after trimming. Underwriters Laboratories' standards specify that the edge should be measured at least ⅜-inch (10 mm) from a cut edge and at least ¾-inch (20 mm) from the mill edge. Thus, if the feather is severe, the gage targets must be adjusted upwardly to avoid undersize edges with resultant strip overweight.

SUMMARY OF THE INVENTION

It is, therefore, an object of the present invention to provide an improved method of rolling metal strip.

It is a further object to provide an improved method of rolling metal strip which accounts for and permits adjustment for edge taper.

It is another object to provide a method of controlling edge taper in a rolled metal workpiece through the control of mill stand rolling force and work roll crown.

The foregoing and other objects are achieved in accordance with the present invention by a method used in a rolling mill having at least one pair of opposed rolls and some method for modifying effective crown of at least one such roll. The method of the present invention controls the edge taper of a workpiece produced to a specified final workpiece gage and crown. This method provides for first establishing a target rolling pressure or force per unit of width for the final pass through the mill as a function of the desired maximum edge taper. A target crown for the workpiece on the final rolling pass is established along with a determination of the effective mill crown (roll crown) which will produce the target crown for the workpiece with the target rolling pressure. The roll crown is then adjusted to this effective value for the final pass of the strip through the rolls.

BRIEF DESCRIPTION OF THE DRAWINGS

While the present invention is particularly defined in the claims annexed to and forming a part of this specification, a better understanding can be had from the following description taken in conjunction with. the accompanying drawings which:

DETAILED DESCRIPTION

Figure 1:
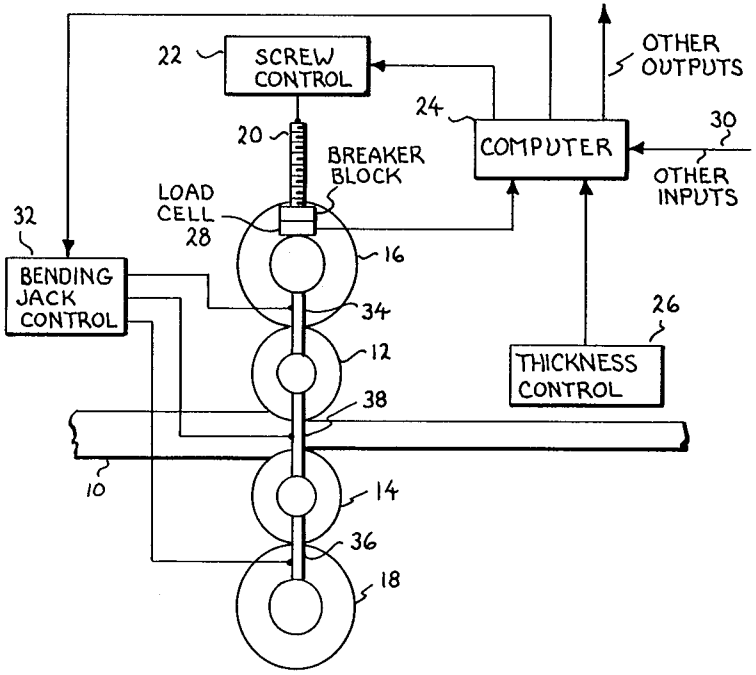
FIG. 1 is a block diagram of the environment and the elements utilized in the practice of the present invention.

Reference is first made to FIG. 1 which shows in schematic form a typical mill stand such as might be employed in the implementation of the method of the present invention. It is to be understood that the depiction of FIG. 1 is in schematic form and shows only the essential elements which are pertinent to the present invention. Further, it is understood that depiction of FIG. 1 may be the last stand of a tandem mill in which the present invention would be employed or alternately would represent the final pass of the workpiece through the stand in a reversing mill.

In FIG. 1, it is seen that a workpiece 10 is passed between an upper workroll 12 and a lower workroll 14 to effect reduction of that strip. The stand illustrated in FIG. 1 is a "four-high" stand and thus also includes an upper backup roll 16 and a lower backup roll 18, all in a manner well known in the art. The force and draft of the rolls are controlled through a suitable means such as a screw mechanism indicated at 20 under the control of a screw control 22 which controls roll position. Other forms of roll position control, such as hydraulic means, could be used with equal facility. A suitable computer 24, such as Digital Equipment Corporation VAX-11-780 computer, receives certain inputs from the system and performs computations to provide output as is typical in the art. Specifically, with respect to the present invention, computer 24 would receive an input from a thickness gage 26 which could be a traversing thickness gage to thus measure the thickness and crown of the output strip. Computer 24 also receives an input from a suitable load cell 28 which is shown as disposed between the screw 20 and the upper backup roll 16 to provide to that computer a signal proportional to the rolling force. Other inputs not pertinent to the present invention are shown as being derived by bus 30 and would include, as is well known in the art, such things as roll speed, operator inputs, etc. Computer 24 will provide, inter alia, output control signals to the screw control 22 earlier mentioned to thus control the roll position and force and to a bending jack control 32, which in turn, controls the operation of three bending jacks on each side of the rolls. As depicted, a first bending jack 34 is located between the upper backup roll 16 and the upper workroll 12 while a second jack 36 operates between the lower backup roll 18 and the lower workroll 14. A third bending jack 38 is disposed between the two workrolls 12 and 14. Thus, in response to the computations pursuant to the operation of the present invention to be described, the workroll crown can be modified in accordance with known principles.

Figure 2:
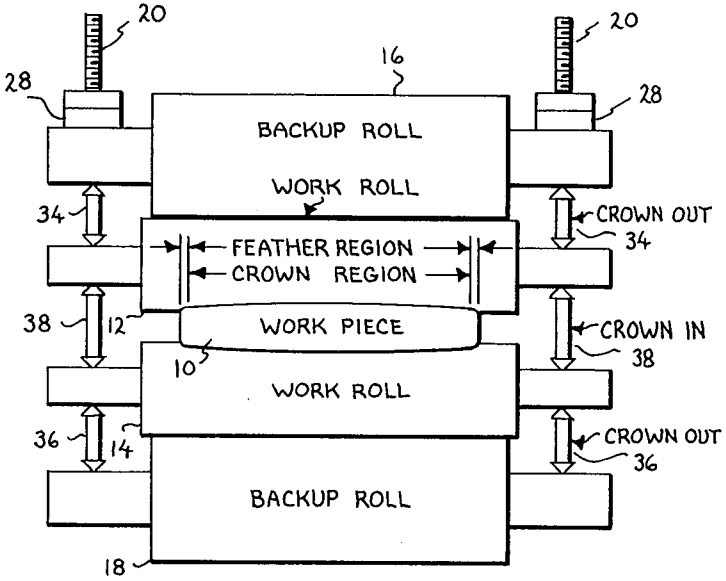
FIG. 2 is a block schematic diagram of a rolling mill stand and a now being rolled workpiece and further illustrating the overall mill stand structure as.well as roll bending forces.

FIG. 2 illustrates, in schematic form, some additional detail of the metal rolling stand of FIG. 1. Like elements have been designated by like characters. Specifically what FIG. 2 is designed to show is the effect of the roll bending forces as well as the feather and crown regions of the workpiece. With respect first to the roll bending system, it is seen that the backup roll to workroll jacks 34 and 36, when operated to exert pressure in the direction indicated by the arrows, will force the workrolls to assume a more concave configuration, i.e., they remove crown from the workrolls. The opposite effect is achieved by operation of the bending jacks 38 which are located between the two workrolls. If these jacks exert pressure in the direction of the arrows, a greater crown, i.e., a more convex appearance is given to the workroll profile.

Figure 3:
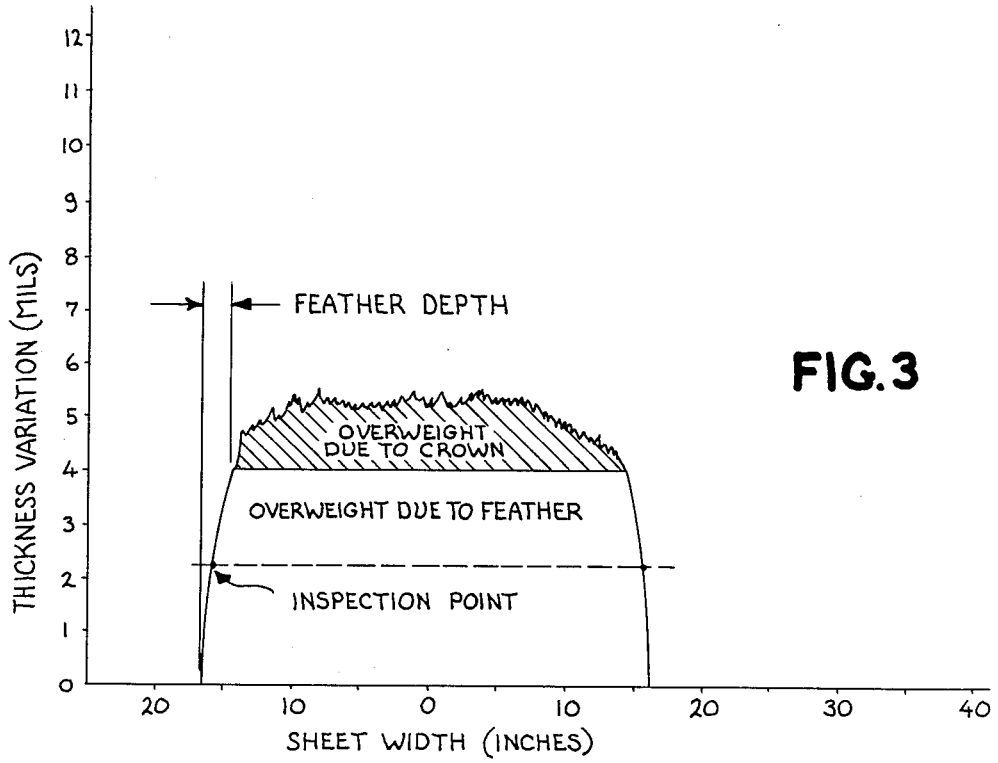
FIG. 3 is a graphical representation of a rolled workpiece illustrating strip crown and feather.

Also illustrated in FIG. 2 is the workpiece 10 which has had its crown and feather regions greatly exaggerated. As illustrated, the feather region appears near each edge of the strip and tends to be rather severe while the crown region extends across the greater width of the workpiece as illustrated FIG. 3 is a graphical representation of the thickness variation across the width of a typical sheet such as might exist in a rolling mill today. FIG. 3 shows what is, approximately, a 32-inch strip and it is seen that the total variation of strip thickness throughout the major portion of the width is represented by that region represented by crown. At about fourteen inches from the center line of the strip, it is seen that the strip thickness drops off rather abruptly. This is referred to here as the feather region. In this abrupt slope or feather region is located, in this example, the inspection point in accordance with the Underwriters Laboratories' standards earlier mentioned. Thus considerable overweight will exist in this strip due to feather, more, in this example, than is due to strip crown. A perfectly rolled strip would have no crown and no feather such that the total depiction as shown in FIG. 3 would be a rectangular configuration without crown or feather. Such, however, is not practical and since the inspection point is as indicated, it is at least as important to reduce feather as to reduce crown in improving the efficiency of the rolling process.

Figure 7:
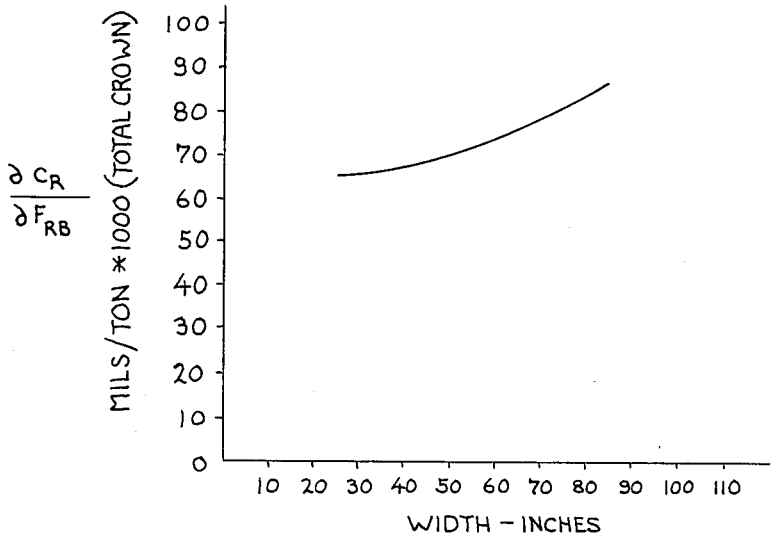
FIG. 7 is a graph showing the partial derivative of roll crown with respect to roll bending force as a function of workpiece width; and, FIG. 8 is a graphical representation showing the results of field tests compared to the predicted values calculated in accordance with the present invention.
Figure 4:
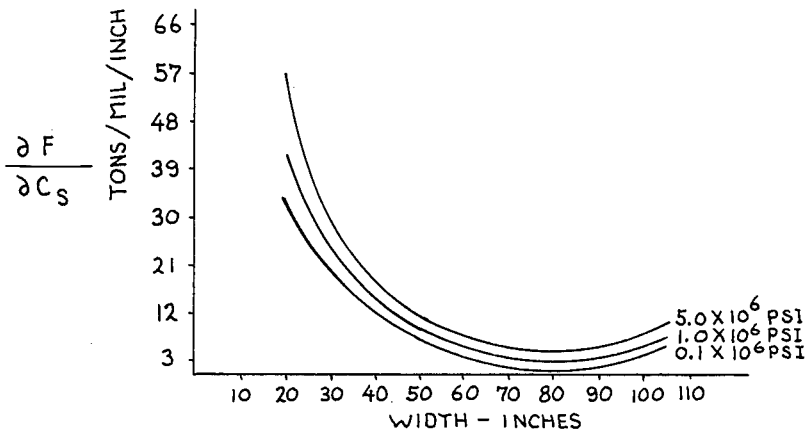
FIGS. 4 through 6 are curves showing the partial derivatives of force with respect to specified parameters (target crown, roll crown and entry crown) as a function of workpiece width.
Figure 5:
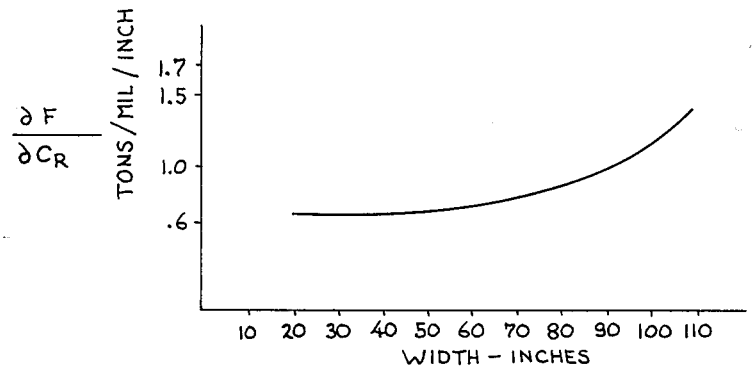
Figure 6:
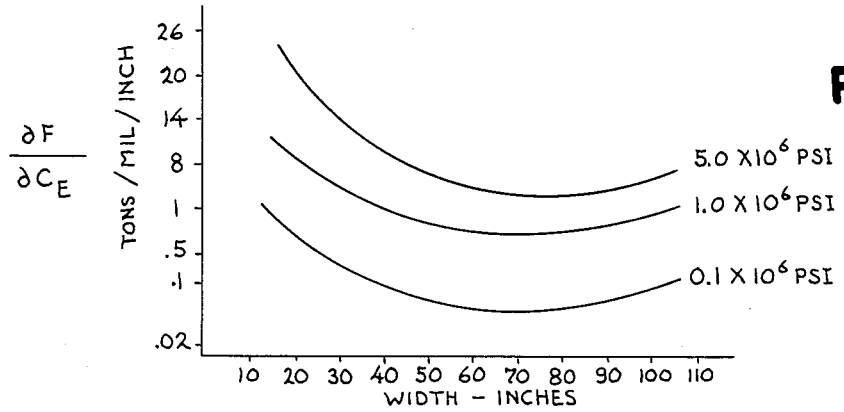

FIGS. 4 through 7 are various graphical representation useful in understanding the method of the present invention. FIG. 4 represents the partial derivative of roll force per unit of width with respect to the targeted or desired roll strip crown $C_S$ while FIG. 5 represents partial derivative of roll force per unit of width with respect to the roll crown CR FIG. 6 represents the partial derivative of roll force per unit of width with respect to the strip entry crown $C_E$; that is, the crown of the strip as it enters the rolling stand. FIG. 7 represents the partial derivative of the roll crown with respect to the force of the roll bending system. All of the depictions of FIGS. 4 through 7 are shown as plotted against the width of the workpiece in inches. It is noted that FIGS. 4, 5 and 6 are identical to FIGS. 2, 3 and 4 of the referenced U.S. Pat. No. 4,137,741 excepting that the labeling of the ordinate axis has been modified to conform with the language used in this specification, as will be more fully understood as this description proceeds.

Figure 8:
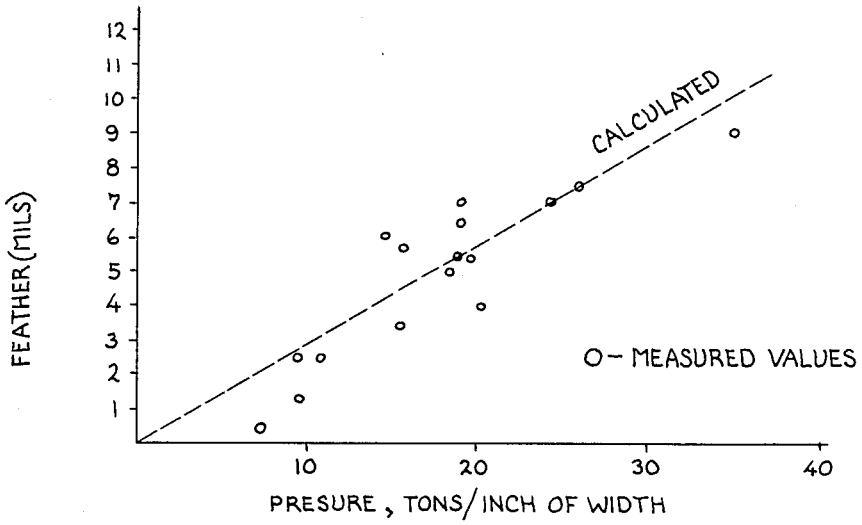

FIG. 8 shows the results of field tests designed to confirm the relationship between rolling pressure and strip edge taper employed in the present method.

With the foregoing background information in mind, the method of controlling feather of a rolled strip in accordance with the present invention will now be explained. It has been found that edge taper or feather can be reduced by reducing the rolling pressure on the last pass of the strip through a mill stand. This reduction in pressure, or force per unit of width, must, however, be made within the constraints of strip crown and flatness as defined by the two aforementioned Fapiano et al. patents, particularly U.S. Pat. No. 4,137,741.

As such, the first step in the method of the present invention is to find the limit of the force per unit of strip width ($F_{limit}$) for a selected maximum allowable edge taper. In accordance with the preferred specific embodiment of the present invention this limit may be derived from the equation:

$$F_{limit} = T/\left[\frac{2\delta}{3} + 2\delta \ln \frac{2 \cdot D}{\sqrt{R'\Delta h}}\right] K \quad (1)$$

wherein:

T=selected maximum allowable edge taper (feather)

$\delta=(1-\nu^2)/\pi$. E, in which $\nu$=Poisson's ratio for workrolls

E=workroll shell elastic modulus $\Delta h$=reduction in strip thickness

D=workroll diameter

R'=deformed roll radius as defined by Hitchcock's equation, (reference "*The Rolling of Metals*", Vol. 1, L. R. Underwood. John Wiley and Sons, Inc., New York, N.Y., 1950)

$$R' = R\left(1 + \frac{16\delta F}{\Delta h}\right) \quad (2)$$

in which, further

R=undeformed workroll radius

F=force per unit of strip width, and,

K=a constant, approximately 3118. The constant K is derived from the factors:

$$K = 2 \cdot \frac{\sqrt{3}}{2} \cdot 2000 \cdot 0.9 \quad (3)$$

The factor 2 relates to the fact that there are two workrolls while $\sqrt{3}/2$ is an adjustment from plane to three-dimensional strain at the strip edge. The 2000 factor is for converting tons to pounds while 0.9 is an experienced adjustment for overstatement of roll deformation by Hitchcock's equation.

Equation (1) is essentially similar to that of Hertz (H. Hertz "Gesammelte Werke", Vol. I, Leipzig 1985) for compression of a cylinder and flat plate, with the length of the contact arc in accordance with Hitchcock using the shell elastic modulus, and an experimental adjustment factor. The results of tests planned by the inventor of the present method to produce a wide range of rolling pressures are shown in FIG. 8, along with edge tapers calculated by equation (1). Thus, there is given a reasonably simple expression which has proven sufficiently accurate to predict, and therefore to control, edge taper.

The next step is to determine the roll crown ($C_R$) that will produce the target crown ($C_S$) with the maximum allowable pressure $F_{limit}$ as defined above. In the preferred embodiment of the present invention, this is achieved in accordance with the method as set forth in the aforementioned U.S. Pat. No. 4,137,741. In that patent the force per unit width to achieve the target crown is defined as "F" and is given by the equation:

$$F=(RM)(RD)[(MH)(PCW)(TC)+(RCW)(ERC)-(ECU)(SEC)] \quad (4)$$

wherein:

F is the force per unit width to achieve the target crown,

RM is proportional to the modulus of elasticity of the opposed rolls,

RD is proportional to the diameter of the opposed rolls,

MH is proportional to resistance to deformation of the workpiece,

PCW is proportional to the width of the workpiece,

TC is proportional to the target crown for the workpiece,

RCW is proportional to the width of the plate,

ERC is proportional to the effective crown of the opposed rolls,

ECW is porportional to the width of the workpiece, and,

SEC is proportional to the entry crown of the workpiece.

Using the terminology of the present application, including that shown by the graphs of FIGS. 4, 5 and 6, equation (4) may be rewritten as:

$$F_{limit} = \frac{\partial F}{\partial C_S} \cdot C_S + \frac{\partial F}{\partial C_R} \cdot C_R - \frac{\partial F}{\partial C_E} \cdot C_E \quad (5)$$

Solving equation (5) for the required workroll crown gives:

$$C_R = \left[F_{limit} - \frac{\partial F}{\partial C_S} \cdot C_S + \frac{\partial F}{\partial C_E} \cdot C_E\right] / \frac{\partial F}{\partial C_R} \quad (6)$$

This $C_R$ is, as was earlier stated, the roll crown which will produce the target crown at the maximum allowable pressure, $F_{limit}$.

The above calculations are, of course, performed in the computer 24 (FIG. 1) using stored values corresponding to the curves of FIGS. 4, 5 and 6. The roll crown is adjusted by adjusting the roll bending force to correct roll crown "errors"; i.e., the differences between desired and actual roll crowns.

The actual workroll crown is comprised, essentially of the sum of four components. These are:

(1) the roll crown actual ground onto the roll, (2) the thermal crown change—which can be tracked by the computer as the roll changes temperature, (3) the crown change due to wear—which can also be tracked by the computer, and, (4) crown change due to roll bending ($\Delta C_{RB}$).

Since the first three components are known and can be stored in the computer as constants, (albeit, in the case of (2) and (3), instantaneous constants) the actual workroll crown can be adjusted to the desired value as calculated above by the roll bending means. This change in roll crown as a function of roll bending ($\Delta C_{RB}$) is defined by the relationship $$\Delta C_{RB} = \Delta F_{RB} \cdot \frac{\partial C_R}{\partial F_{RB}}$$

wherein:

$F_{RB}$=roll bending system force, and, $\frac{\partial C_R}{\partial F_{RB}}$ = relationship as defined by the partial derivative curve of FIG. 7, earlier described.

Thus it is seen that the maximum amount of feather desired is achieved while the shape constraints as set forth in U.S. Pat. No. 4,137,741 are maintained. If the $F_{limit}$ as derived from equation (1), when employed in crown equation (6), exceeds the constraints of that latter equation, for example, due to limited range of the roll bending system, then it may be possible through an iterative process to adjust the forces on previous passes of the strip in accordance with the teachings of the U.S. Pat. No. 4,137,741. If such is not possible, then it will be necessary to compromise the mill stand set up for the last pass. Since the flatness requirements, which dictate strip crowns on successive passes, are normally more important than reduction in edge taper, this compromise will normally be in permitting greater edge taper.

While there has been shown and described what is at present considered to be the preferred embodiment of the present invention, modifications thereto will readily occur to those skilled in the art. For example, while the present invention is preferably practiced in a mill having roll bending capabilities, in a mill where a single product were being repetitively rolled, at least some of the advantages of the present invention could be achieved by practicing roll grinding in accordance with the teachings of this invention. Further, there are other methods of altering effective roll crown, such as the variable crown backup roll, described in "Shape Control of Steel Strip With Sumitomo Variable Crown Roll System" by T. Kurashige, et al., *Proc. International Conference on Steel Rolling, The Iron and Steel Institute of Japan,* Sept. 29–Oct. 4, 1980, Tokyo, Japan, p. 521, and changes to the roll spray distribution which is well known in the art. It is not desired, therefore, that the invention be limited to the specific arrangement shown and described and it is intended to cover, in the appended claims, all such modifications as fall within the true spirit and scope of the invention.

I claim:

1. For use in a metal rolling mill having at least one pair of opposed workrolls for reducing the thickness of a metal workpiece passed therebetween, a method for controlling edge taper on the workpiece produced to a specified final gage and crown comprising the steps:

(a) establishing a target rolling pressure for the final pass of the workpiece through the workrolls as a function of a desired maximum amount of edge taper;

(b) establishing a target crown for the workpiece after said final pass;

(c) determining a final roll crown which will produce the target crown for the workpiece using said target rolling pressure; and, (d) adjusting the crown of said rolls to said final roll crown.

2. The method in accordance with claim 1 wherein said target rolling pressure is established in accordance with the relationship, $$F_{limit} = T/\left[\frac{2\delta}{3} + 2\delta \ln \frac{2 \cdot D}{\sqrt{R'\Delta h}}\right] K$$

wherein:

$F_{limit}$=target rolling pressure (force per unit width)

T=desired maximum amount of edge taper $\delta=(1-\nu^2)/\pi.E$, in which $\nu$=Poisson's ratio for workrolls E=workroll shell elastic modulus $\Delta h$=reduction in strip thickness D=workroll diameter R'=deformed roll radius K=constant 3. The method in accordance with either claim 1 claim 2 in which said final roll crown ($C_R$) is established in accordance with the relationship:

$$C_R = \left[F_{limit} - \frac{\partial F}{\partial C_S} \cdot C_S + \frac{\partial F}{\partial C_E} \cdot C_E\right] / \frac{\partial F}{\partial C_R}$$

wherein:

$F_{limit}$=target rolling pressure (force per unit width)

F=mill rolling force per unit of strip width $C_S$=target crown of the workpiece $C_E$=workpiece crown at time of entry between workrolls $C_R$=effective crown of workrolls.

4. For use in a metal rolling mill having at least one pair of opposed work rolls for reducing the thickness of a metal workpiece passed therebetween and means for changing the effective crown on at least one of the workrolls, a method for controlling edge taper on the workpiece produced to a specified final gage and crown comprising the steps:

(a) establishing a target rolling pressure for the final pass of the workpiece through the workrolls as a function of a desired maximum amount of edge taper;

(b) establishing a target crown for the workpiece after said final pass;

(c) determining a final roll crown which will produce the target crown for the workpiece using said target rolling pressure; and (d) controlling the means for changing the effective crown to provide said effective roll crown on said final pass.

5. The method in accordance with claim 4 wherein said target rolling pressure is established in accordance with the relationship, $$F_{limit} = T/\left[\frac{2\delta}{3} + 2\delta \ln \frac{2 \cdot D}{\sqrt{R'\Delta h}}\right] K$$

wherein $F_{limit}$=target rolling pressure (force per unit width)

T=desired maximum amount of edge taper $\delta=(1-\nu^2)/\pi.E$, in which $\nu$=Poisson's ratio for workrolls E=workroll shell elastic modulus $\Delta h$=reduction in strip thickness D=workroll diameter R'=deformed roll radius K=constant

6. The method in accordance with either claim 4 or claim 5 in which said final roll crown ($C_R$) is established in accordance with the relationship:

$$C_R = \left[ F_{limit} - \frac{\partial F}{\partial C_S} \cdot C_S + \frac{\partial F}{\partial C_E} \cdot C_E \right] / \frac{\partial F}{\partial C_R} \quad (6)$$

wherein:

$F_{limit}$=target rolling pressure

F=mill rolling pressure $C_S$=target crown of the workpiece $C_E$=workpiece crown at time of entry between workrolls $C_R$=effective crown of workrolls.

* * * * *